US006042210A

United States Patent [19]

Suematsu et al.

[11] Patent Number: 6,042,210

[45] Date of Patent: Mar. 28, 2000

[54] MATRIX DRIVING CIRCUIT OF AN INK JET PRINTER AND A METHOD OF DRIVING THE SAME

[75] Inventors: Shigenori Suematsu; Takao Matsuoka; Masahiro Shimohori; Eiichi Toyama; Toshio Fuji, all of Hitachinaka, Japan

[73] Assignee: Hitachi Koki Company Ltd., Tokyo, Japan

[21] Appl. No.: 08/695,801

[22] Filed: Aug. 12, 1996

[30] Foreign Application Priority Data

Aug. 11, 1995 [JP] Japan ..... 7-205841

[51] Int. Cl.[7] ..... B41J 29/38

[52] U.S. Cl. ..... 347/12

[58] Field of Search ..... 347/10–13, 69, 347/180, 181

[56] References Cited

FOREIGN PATENT DOCUMENTS 664166 3/1994 Japan .

*Primary Examiner*—John Barlow
*Assistant Examiner*—Charles W. Stewart, Jr.
*Attorney, Agent, or Firm*—Whitham, Curtis & Whitham

[57] ABSTRACT

An ink jet printer has a plurality of piezoelectric elements arranged in a matrix form in which each piezoelectric element is connected between one of TS lines and one of selection lines. The TS lines are connected, one by one and in a time sharing manner, to a voltage source $E_1$ so as to be enabled. The remaining TS lines are connected to a voltage source $E_2$ so as to be disabled. The selection lines are selectively connected to a voltage source $E_3$ so as to be enabled. Non-selected selection lines are connected to a voltage source $E_4$ so as to be disabled. A selected piezoelectric element connected between enabled TS line and enabled selection line is applied with a driving voltage. A non-selected piezoelectric element connected between enabled TS line and disabled selection line, or between disabled TS line and enabled selection line, or between disabled TS line and disabled selection line, is applied with a non-driving voltage. The voltages supplied from the respective voltage sources are selected so that the non-driving voltage is one third or minus one third of the driving voltage. With the thus determined non-driving voltage, no ink droplet is ejected from a nozzle corresponding to the non-selected piezoelectric element while ensuring a sufficient amount of ink to be ejected from a nozzle corresponding to the selected piezoelectric element.

25 Claims, 7 Drawing Sheets

MATRIX DRIVING CIRCUIT OF AN INK JET PRINTER AND A METHOD OF DRIVING THE SAME

BACKGROUND OF THE INVENTION

1. Field of the Invention

The present invention relates to a matrix driving circuit of an ink jet printer with a plurality of piezoelectric elements arranged in a matrix form. The invention also relates to a method of driving the matrix driving circuit of such an ink jet printer.

2. Description of the Related Art

FIG. 1 shows a cross-section of a nozzle unit in a conventional ink jet printer. A predetermined number of nozzle units are arranged in the direction perpendicular to the sheet of drawing. A pressure chamber 2 is generally defined by a nozzle plate 11, a partition membrane 3, an upper wall 12 and a lower wall 13. The pressure chamber 2 is in fluid communication with an ink tank (not shown) through an ink channel 9 and is filled with an ink. A predetermined number of nozzles 1 are formed in the nozzle plate 11. Each nozzle 1 has a decreasing diameter toward the outer surface of the nozzle plate 11. Ink droplets are ejected the nozzles.

A piezoelectric element 4 is disposed just behind the partition membrane 3 and oriented in such a direction that the longitudinal axis of the piezoelectric element 4 extends perpendicular to the surface of the membrane 3. One end of the piezoelectric element 4 is attached to the partition membrane 3 and the opposite end thereof is fixedly secured to a frame 10. The piezoelectric element 4 has a rectangular cross-section. A positive electrode 5 is attached to the upper side surface of the piezoelectric element 4 and a negative electrode 6 is attached to the lower side surface of the piezoelectric element 4. The piezoelectric element 4 is, for example, of an electric field controlled type. The piezoelectric element 4 shown in FIG. 1 is a D31 type in which the piezoelectric element 4 contracts in the longitudinal direction as indicated by an arrow when a voltage is applied between the positive and negative electrodes 5 and 6. The piezoelectric element 4 contracts in the longitudinal direction in approximately proportional to a voltage applied therebetween.

In operation, a voltage $V_0$ is applied across the piezoelectric element at the time of a standby condition and a voltage $V_1$ is applied thereacross at the time of ejection. In response to the voltage $V_1$, the piezoelectric element 4 contracts in the longitudinal direction, whereby the volume of the pressure chamber 2 increases and ink is supplemented through the ink channel 9. When application of the voltage $V_1$ terminates, the volume of the pressure chamber 2 reverts to an initial condition. At this time, an ink droplet is ejected from the nozzle 1. Printing on a recording medium is thus carried out.

In recent years, it has been proposed a multi-printhead with a plurality of nozzle units arranged in parallel to increase a printing speed. An attempt to increase the printing speed by increasing the number of nozzle units encountered a problem such that as the number of nozzle units increases, the number of wirings for supplying currents to the respective piezoelectric elements 4 also increases. This makes it difficult to arrange the nozzle units.

To solve this problem, a matrix driving of the piezoelectric elements has been proposed as disclosed in Japanese Laid-Open Patent Publication (Kokei) No. HEI-6-64166. In the driving method according to this publication, a plurality of charging switching elements are provided to respective ones of a plurality of piezoelectric elements and also a single discharging switching element is provided commonly to all of the piezoelectric elements, so that the piezoelectric elements are repeatedly charged and discharged by the actions of the switching elements. In this arrangement, the more the configuration of the driving circuit is simplified, the more the number of nozzles to be operated simultaneously increases. The printing speed is also increased.

In the matrix driving as disclosed in the publication No. HEI-6-64166, a half of the driving voltage on an enabled common or time sharing lines is distributedly applied to the non-driving piezoelectric elements. Due to this distributed voltage, an ink droplet is ejected from a particular nozzle corresponding to a non-driving piezoelectric element.

FIG. 3 shows an explanatory diagram for illustrating distributed voltages, and FIG. 4 shows a timing chart for describing the operation of the matrix driving circuit to which the distributed voltages are applied.

As shown in FIGS. 3 and 4, it is assumed that when a voltage $V_0$ is applied to the second time sharing line $X_2$, a quarter of the voltage $V_0$, i.e., $\frac{1}{4}\cdot V_0$, is applied as a distributed voltage to the remaining time sharing lines $X_1$, $X_3$, and $X_4$ and that zero volt is applied to the selection lines $Y_2$ and $Y_3$ and $\frac{1}{2}\cdot V$, is applied to the remaining selection lines to drive the piezoelectric elements $P_{22}$ and $P_{23}$. In this condition, the voltage $V_0$ is developed across the piezoelectric elements $P_{22}$ and $P_{23}$ so that ink droplets are ejected from the corresponding nozzles. The voltage of $\frac{1}{4}\cdot V_0$ is applied across the remaining piezoelectric elements except the piezoelectric element $P_{21}$. With the voltage of $\frac{1}{4}\cdot V_0$, no ink droplet is ejected from the corresponding nozzles. However, the piezoelectric element $P_{21}$ is applied with the voltage $V_0$ on its positive electrode and the voltage $\frac{1}{2}\cdot V_0$ on its negative electrode, thus a forward voltage of $\frac{1}{2}\cdot V_0$ is developed across the piezoelectric element $P_{21}$, resulting in an ejection of ink droplet from the corresponding nozzle. Hereinafter, the voltage on the positive electrode relative to the voltage on the negative electrode of the piezoelectric element will be referred to as "a differential voltage", the differential voltage for driving the piezoelectric element will be referred to as "driving differential voltage", and the differential voltage for non-driving the piezoelectric element will be referred to as "non-driving differential voltage".

FIG. 2 shows a relationship between a driving differential voltage dV applied across the piezoelectric element and an amount of ink ejected from the corresponding nozzle. As can be seen from the solid line in FIG. 2, ink will not be ejected from the nozzle if the driving differential voltage is below dVx. Therefore, it would be possible not to eject ink from the nozzle if the distributed voltage applied to the non-driving piezoelectric elements is below this critical voltage.

However, the characteristic curve regarding the driving differential voltage vs. amount of ink will vary in a range indicated by two two-dotted-chain lines. Therefore, in actuality, a small amount of ink may flow out from the nozzle when a half of the driving voltage is applied to the non-driving piezoelectric element. The ink thus flowed out from the nozzle causes clogging of the nozzle and bothers the subsequent ink ejection.

If the driving differential voltage is lowered to solve the above-mentioned problem, a sufficient amount of ink may not be ejected from the nozzle when the corresponding piezoelectric element is driven.

SUMMARY OF THE INVENTION

The present invention has been made to solve the above-mentioned problems accompanying the conventional driving methods. Accordingly, it is an object of the present invention to provide a matrix driving circuit of an ink jet printer and also a method of driving the same wherein the driving differential voltage applied to the non-driving piezoelectric element is set to minimum so that ink is not flowed out or ejected from the nozzle corresponding to the non-driving piezoelectric element.

It is another object of the present invention to provide a matrix driving circuit and a method of driving the same wherein a sufficient amount of ink can be ejected from the nozzle corresponding to the driving piezoelectric element.

It is still another object of the present invention to provide a matrix driving circuit of the in jet printer which is highly reliable and less costly.

A matrix driving circuit according to the present invention includes a plurality of piezoelectric elements, N-number time shearing lines, and M-number selection lines wherein N and M are integers equal to or greater than two. The piezoelectric elements are divided into N groups so that each of the N groups contains M-number piezoelectric elements. The piezoelectric elements are further divided into M sub-groups so that each of the M sub-groups contains N-number piezoelectric elements belonging to respective ones of the N groups individually. Each piezoelectric element has a first electrode and a second electrode. The N-number time shearing lines are provided in one-to-one correspondence to the N groups and connected to the first electrodes of the M-number piezoelectric elements belonging to corresponding groups. The M-number selection lines are provided in one-to-one correspondence to the M sub-groups and connected to the second electrodes of the N-number piezoelectric elements belonging to corresponding sub-groups.

In the driving method of the present invention, a driving differential voltage is applied to a selected piezoelectric element through a corresponding time shearing line and a corresponding selection line, and a non-driving differential voltage is applied to a non-selected piezoelectric element, wherein the non-driving differential voltage is one third or minus one third of the driving voltage. With the thus determined non-driving differential voltage, no ink droplet is ejected from a nozzle corresponding to the non-selected piezoelectric element whereas an ink droplet is ejected from a nozzle corresponding to the selected piezoelectric element.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENTS

Preferred embodiments of the present invention will be described with reference to the accompanying drawings.

Figure 1:
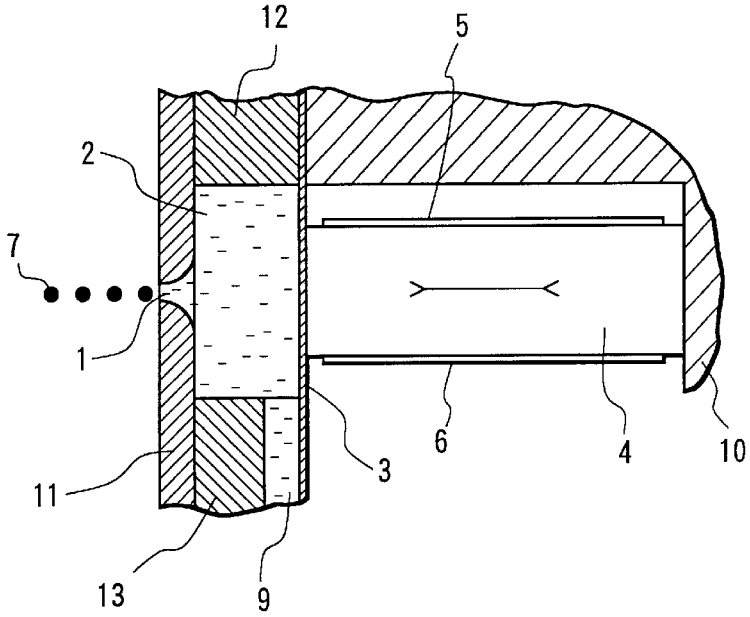
FIG. 1 PRIOR ART
FIG. 1 is a cross-sectional view showing a nozzle unit of a conventional ink jet printer.
Figure 2:
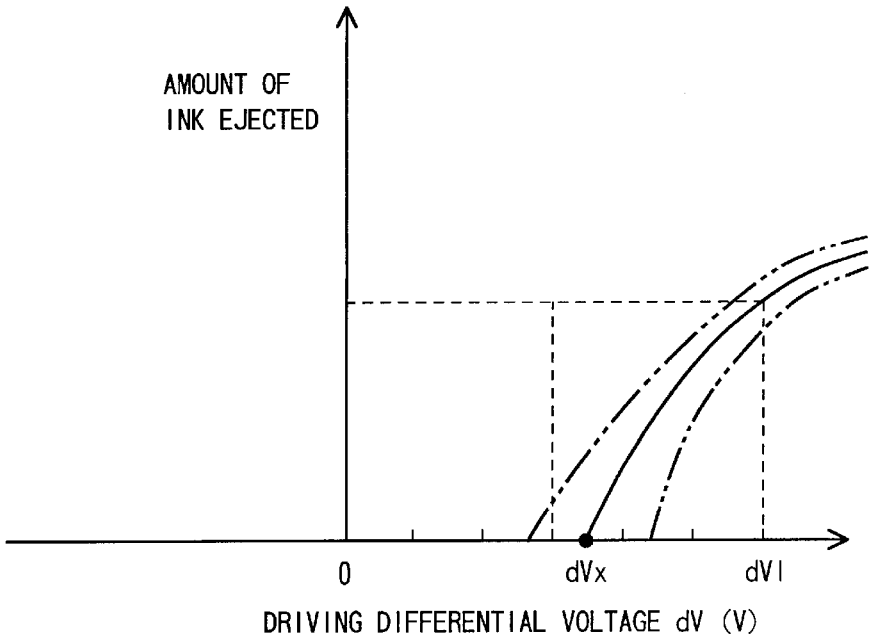
FIG. 2 PRIOR ART
FIG. 2 is a graphical representation showing a relationship between a driving differential voltage applied to a piezoelectric element and an amount of ink ejected from a nozzle.
Figure 3:
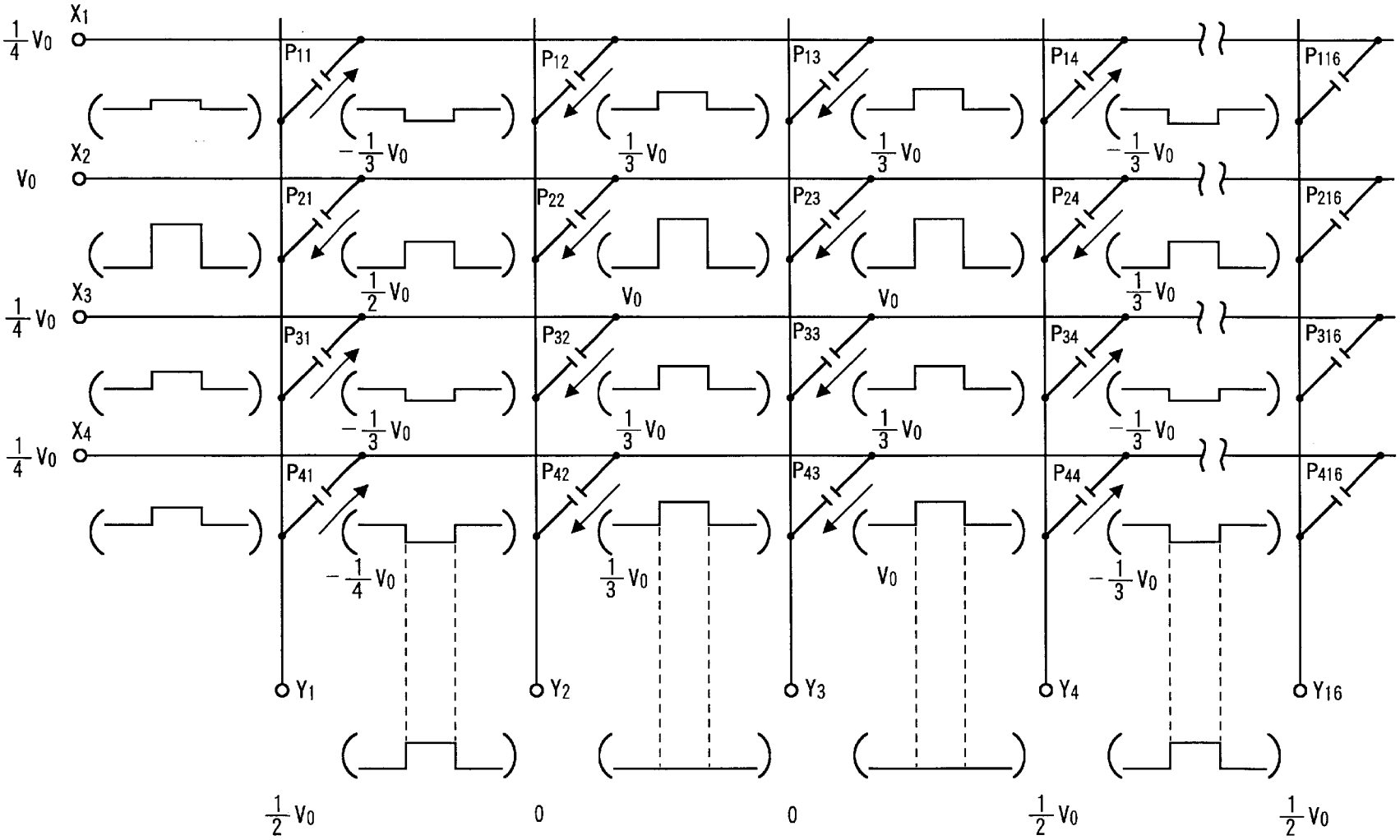
FIG. 3 PRIOR ART
FIG. 3 is an explanatory diagram for describing voltages distributed to non-driving piezoelectric elements.
Figure 4:
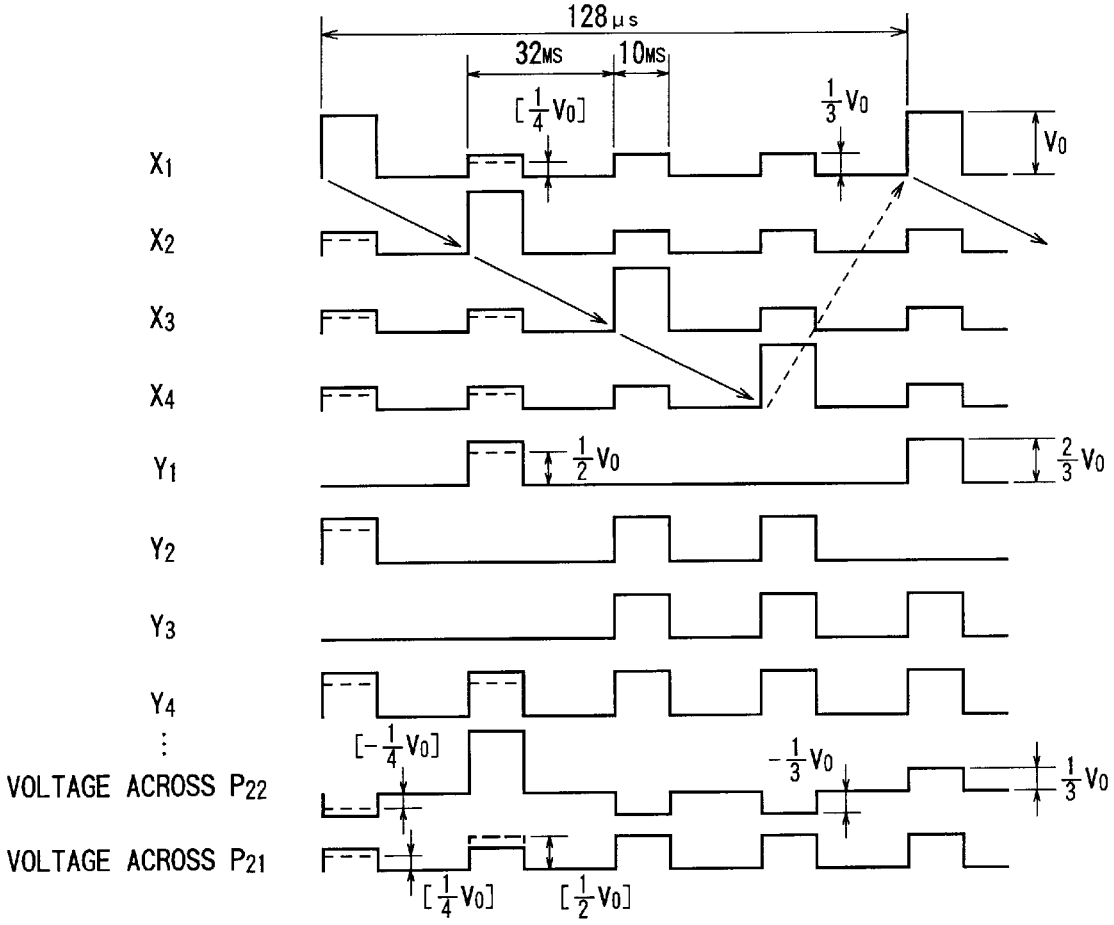
FIG. 4 PRIOR ART
FIG. 4 is a timing chart of the voltages applied to respective electrodes of the piezoelectric elements for describing the operation of piezoelectric elements shown in FIG. 3.

A first embodiment of the present invention will be described with reference to FIGS. 5 and 6. An ink jet printer used in the first embodiment is the same as that shown in FIG. 1, and therefore the description thereof will not be repeated here. Also, the basic operation of the printer remains the same.

Figure 5:
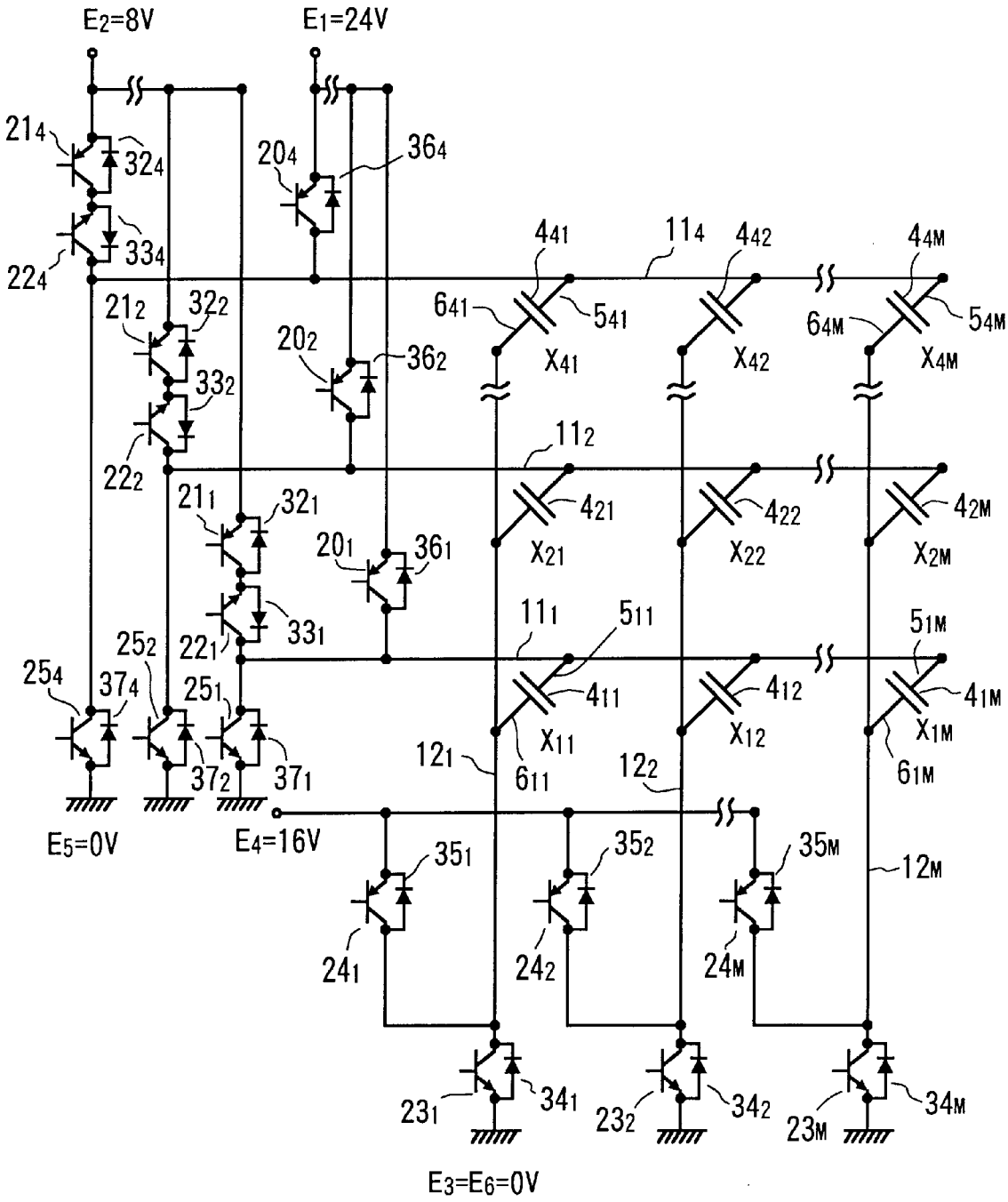
FIG. 5 is a circuit diagram showing a matrix driving circuit of an ink jet printer according to one embodiment of the present invention.

FIG. 5 shows a matrix driving circuit according to the first embodiment of the present invention. As shown therein, a plurality of piezoelectric elements are arranged in a matrix form. The piezoelectric elements are divided into four groups, each containing M-number piezoelectric elements. The piezoelectric elements are further divided into M sub-groups, each containing four piezoelectric elements belonging to respective ones of four groups individually. The total number of piezoelectric elements making up the driving circuit is therefore 4M. The piezoelectric elements belonging to the first group are denoted by $\mathbf{41}_1, \mathbf{41}_2, \ldots, \mathbf{41}_M$, the second group by $\mathbf{42}_1, \mathbf{42}_2, \ldots, \mathbf{42}_M$, the third group by $\mathbf{43}_1, \mathbf{43}_2, \ldots, \mathbf{43}_M$ (not shown in the figure), and the fourth group by $\mathbf{44}_1, \mathbf{44}_2, \ldots, \mathbf{44}_M$.

Four time sharing lines (hereinafter referred to as "TS lines") $\mathbf{11}_1, \mathbf{11}_2, \mathbf{11}_3, \mathbf{11}_4$ are connected to four piezoelectric element groups, respectively. The first TS line $\mathbf{11}_1$ is connected to the positive electrodes $\mathbf{5}_{11}$ through $\mathbf{5}_{1M}$ of the piezoelectric elements $\mathbf{4}_{11}$ through $\mathbf{4}_{1M}$; the second TS line $\mathbf{11}_2$ to the positive electrodes of the piezoelectric elements $\mathbf{4}_{21}$ through $\mathbf{4}_{2M}$; the third TS line $\mathbf{11}_3$ to the positive electrodes of the piezoelectric elements $\mathbf{4}_{31}$ through $\mathbf{4}_{3M}$; and the fourth TS line $\mathbf{11}_4$ to the positive electrodes $\mathbf{5}_{41}$ through $\mathbf{5}_{4M}$ of the piezoelectric elements $\mathbf{4}_{41}$ through $\mathbf{4}_{4M}$.

The first TS line 11 is connected to a first voltage source $E_1$ and a second voltage source $E_2$ through respective drivers. The first voltage source $E_1$ supplies 24 volts and the second voltage source $E_2$ supplies 8 volts. An $E_1$-to-$\mathbf{11}_1$ driver connected between the first voltage source $E_1$ and the first TS line $\mathbf{11}_1$ includes a PNP transistor $\mathbf{20}_1$ and a diode $\mathbf{36}_1$ connected in opposite polarity between the emitter and collector of the transistor $\mathbf{20}_1$. The emitter of the transistor $\mathbf{20}_1$ is connected to the voltage source $E_1$ and a collector thereof to the first TS line $\mathbf{11}_1$. An $E_2$-to-$\mathbf{11}_1$ driver connected between the second voltage source $E_2$ and the first TS line $\mathbf{11}_1$ includes a series connection of a PNP transistor $\mathbf{21}_1$ and an NPN transistor $\mathbf{22}_1$, and diodes $\mathbf{32}_1$ and $\mathbf{33}_1$ connected in parallel to the transistors $\mathbf{21}_1$ and $\mathbf{22}_1$, respectively. The diodes $\mathbf{32}_1$ and $\mathbf{33}_1$ are connected in opposite polarity to the respective transistors similar to the transistor and diode pair of the $E_1$-to-$\mathbf{11}_1$ driver. The emitter of the transistor $\mathbf{21}_1$ is connected to the second voltage source $E_2$ and the collector thereof to the emitter of the transistor $\mathbf{22}_1$. The collector of the transistor $\mathbf{22}_1$ is connected to the first TS line $\mathbf{11}_1$ and also to ground through an NPN transistor $\mathbf{25}_1$.

The second to fourth TS lines $\mathbf{11}_2$ to $\mathbf{11}_4$ are also connected to the first and second voltage sources $E_1$ and $E_2$ through the similarly configured drivers. Specifically, an $E_1$-to-$11_2$ driver connected between the first voltage source $E_1$ and the second TS line $11_2$ includes a PNP transistor $20_2$ and a diode $36_2$, and an $E_2$-to-$11_2$ driver connected between the second voltage source $E_2$ and the second TS line $11_2$ includes a PNP transistor $21_2$, an NPN transistor $22_2$, and diodes $32_2$, $33_2$. An $E_1$-to-$11_3$ driver connected between the first voltage source $E_1$ and the third TS line $11_3$includes a PNP transistor $20_3$ and a diode $36_3$, and an $E_2$-to-$11_3$ driver connected between the second voltage source $E_2$ and the third TS line $11_3$ includes a PNP transistor $21_3$, an NPN transistor $22_3$, and diodes $32_3$, $33_3$ (not shown). An $E_1$-to-$11_4$ driver connected between the first voltage source $E_1$ and the fourth TS line $11_4$ includes a PNP transistor $20_4$ and a diode $36_4$, and an $E_2$-to-$11_4$ driver connected between the second voltage source $E_2$ and the fourth TS line $11_4$ includes a PNP transistor $21_4$, an NPN transistor $22_4$, and diodes $32_4$, $33_4$.

The TS lines $11_1$ through $11_4$ are also connected to ground serving as a fifth voltage source $E_5$ through respective drivers. An $E_5$-to-$11_1$ driver connected between the first TS line and the fifth voltage $E_5$, i.e., ground, includes an NPN transistor $25_1$ and a diode $37_1$ connected in parallel with the transistor $25_1$ in opposite polarity. The collector of the transistor $25_1$ is connected to the first TS line $11_1$ and the emitter thereof to the fifth voltage source $E_5$. Likewise, transistor and diode pairs configured by respective one of NPN transistors $25_2$ through $25_4$ and respective one of diodes $37_2$ through $37_4$ are connected between the fifth voltage source $E_5$ and the respective TS lines $11_2$ through $11_4$.

M-number selection lines $12_1$ through $12_M$ are provided to connect the piezoelectric elements in a matrix form in cooperation with the TS lines $11_1$ to $11_4$. Each of the M-number selection lines is connected to the negative electrodes of the piezoelectric elements arranged in the same column of the four groups. Specifically, the selection line $12_1$ is connected to the negative electrode $6_{11}$ of the piezoelectric element $4_{11}$ belonging to the first group. The selection line $12_1$ is also connected to the negative electrodes of the piezoelectric elements belonging to the second to fourth groups. The selection line $12_2$ is connected to the negative electrode of the piezoelectric element $4_{12}$ belonging to the second group. The selection line $12_2$ is also connected to the negative electrodes of the piezoelectric elements belonging to the second to fourth groups. Likewise, the selection line $12_M$ is connected to the negative electrode $6_{1M}$ of the piezoelectric element $4_{1M}$ belonging to the M-th group. The selection line $12_M$ is also connected to the negative electrodes of the piezoelectric elements belonging to the second to fourth groups.

The selection lines $12_1$ through $12_M$ are connected through respective drivers to ground serving as a third voltage source $E_3$, and also as a sixth voltage source $E_6$. The selection lines $12_1$ through $12_M$ are further connected to a fourth voltage source $E_4$ through respective drivers. The voltage source $E_4$ supplies 16 volts. An $E_3$-to-$12_1$ driver connected between the first selection line $12_1$ and the power source $E_3$, i.e., ground, includes an NPN transistor $23_1$ and a diode connected in parallel with the transistor $23_1$ in opposite polarity. The emitter of the transistor $23_1$ is connected to the third voltage source $E_3$, i.e., ground, and a collector thereof to the selection line $12_1$. An $E_4$-to-$12_1$ driver connected between the first selection line $12_1$ and the fourth voltage source $E_4$ includes a PNP transistor $24_1$ and a diode $35_1$ connected in parallel with the transistor $24_1$ in opposite polarity. The emitter of the transistor $24_1$ is connected to the fourth voltage source $E_4$ and a collector thereof to the first selection line $12_1$. Likewise, transistor and diode pairs configured by respective one of NPN transistors $23_2$ through $23_M$ and respective one of diodes $34_2$ through $34_M$ are connected between the respective selection lines $12_2$ through $12_M$ and the third voltage source $E_3$, i.e., ground. Another transistor and diode pairs configured by respective one of the PNP transistors $24_2$ through $24_M$ and respective one of diodes $35_2$ through $35_M$ are connected between the fourth voltage source $E_4$ and the respective selection lines $12_2$ through $12_M$.

As described, the first, second and fifth voltage sources $E_1$, $E_2$, and $E_5$ are connected to the TS lines $11_1$ through $11_4$ through the respective drivers, and the third, fourth, and sixth voltage sources $E_3$, $E_4$, and $E_6$ are connected to the selection lines $12_1$ through $12_M$ through the respective drivers. The drivers provided in association with the first voltage source $E_1$ sequentially applies 24 volts to selective one of the TS lines $11_1$ through $11_4$ in a time sharing manner. When the first voltage source $E_1$ is connected to the first TS line $11_1$, the first voltage source $E_1$ is not connected to the remaining TS lines but the second voltage source $E_2$ is connected thereto. Likewise, when the first voltage source $E_1$ is connected to the second TS line $11_2$, the first voltage source $E_1$ is not connected to the remaining TS lines but the second voltage source $E_2$ is connected thereto.

When a particular piezoelectric element is to be driven, the corresponding selection line is connected to the third voltage source $E_3$, i.e., ground The selection lines corresponding to non-driving piezoelectric elements are connected to the fourth voltage source $E_4$ to supply 16 volts thereto.

To initialize the all the piezoelectric elements, the TS lines $11_1$ through $11_4$ are connected to the fifth voltage source $E_5$, i.e., ground, and the selection lines $12_1$ through $12_M$ are connected to the sixth voltage source $E_6$, i.e., ground.

As described, in the first embodiment, the third, fifth, and sixth voltage sources $E_1$, $E_5$, and $E_6$ apply zero volt. The first voltage source $E_1$ applies 24 volts that is three times as large as the 8 volts applied by the second voltage source $E_2$. The fourth voltage source $E_4$ applies 16 volts that is twice as large as 8 volts applied by the second voltage source $E_2$.

Figure 6:
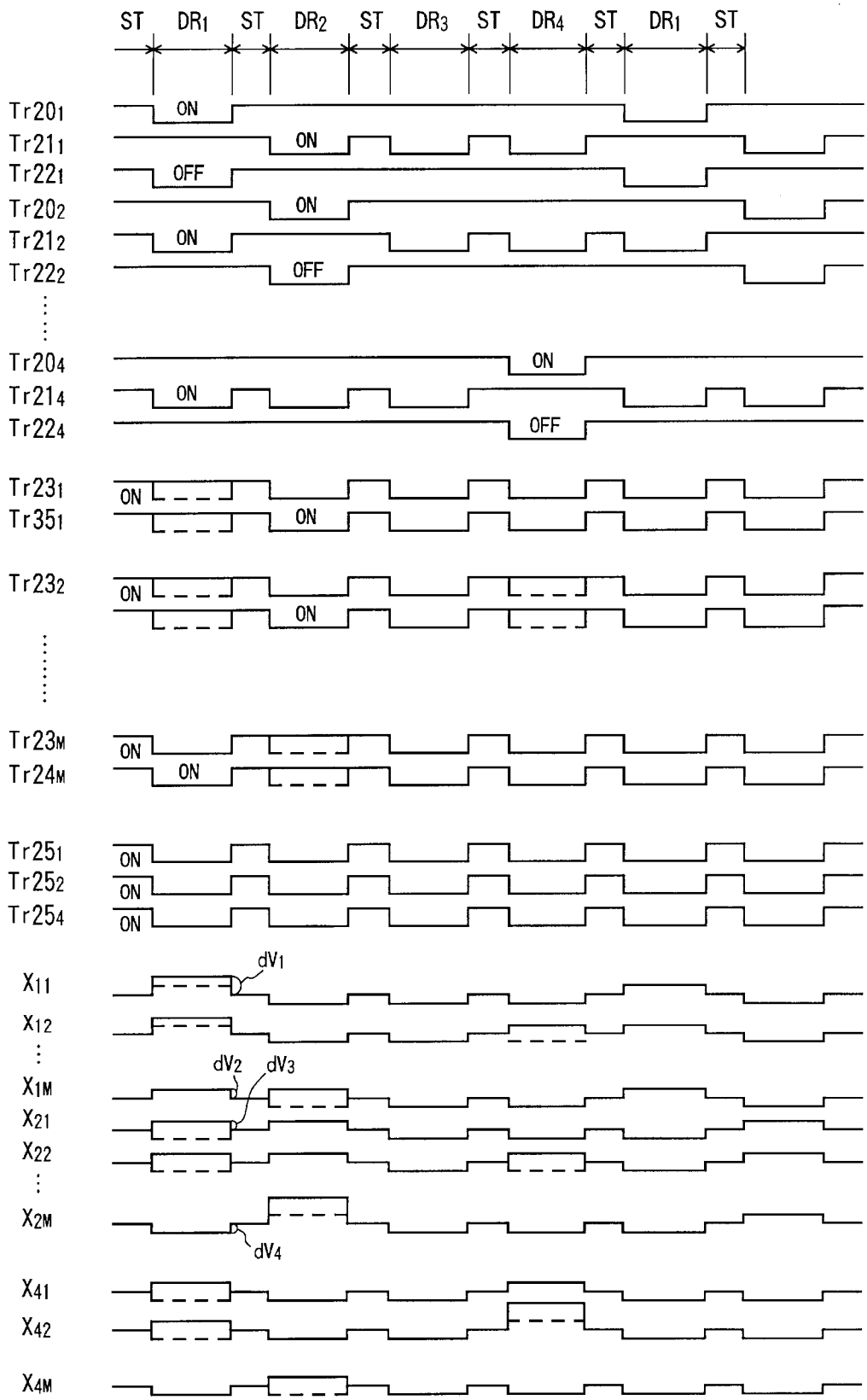
FIG. 6 is a timing chart of various signals applied to the components of the matrix driving circuit shown in FIG. 5 and also voltages developed across the piezoelectric components.

Referring next to FIG. 6, a driving method for the circuit shown in FIG. 5 will be described. FIG. 6 shows timing charts of signals applied to the bases of transistors included in the circuit shown in FIG. 5 and of the voltages developed across the piezoelectric elements. In FIG. 6, $X_{11}$ through $X_{4M}$ denote the voltages developed across the positive electrodes $5_{11}$ through $54_M$ and the negative electrodes $6_{11}$ through $64_M$ of the piezoelectric elements $41_1$ through $44_M$, respectively.

In the standby condition indicated by "ST" in the timing chart of FIG. 6, the transistors $25_1$ through $25_4$ are simultaneously rendered conductive (ON) so that all of the TS lines $11_1$ through $11_4$ are connected to the fifth voltage source $E_5$, i.e., ground, through the transistor $25_1$ through $25_4$. The transistors $23_1$ through $23_M$ are also rendered conductive so that the selection lines $12_1$ through $12_M$ are connected to the sixth voltage source $E_6$, i.e., ground. The remaining transistors are held non-conductive (OFF). Thus, all the piezoelectric elements are initialized and placed in a standby condition.

Following the standby condition "ST", the piezoelectric elements are driven on a group basis. Because the piezoelectric elements are divided into four groups by the TS lines $11_1$ through $11_4$,four phases of drivings complete one cycle of driving. In the timing chart shown in FIG. 6, the first phase driving is indicated by "D1", the second phase driving by "D2", the third phase driving by "D3", and the fourth phase driving by "D4".

In the first phase driving D1, the transistors $25_1$ through $25_4$ are rendered non-conductive, and the transistor $20_1$ is rendered conductive so that the voltage of the power source $E_1$ (24 volts) is applied to the first TS line $11_1$. At this time, the transistor $22_1$ is rendered non-conductive to prevent the voltage source $E_2$ from being interfered by the voltage source $E_1$. The transistors $21_2$, $21_3$ (not shown) and $21_4$ are rendered conductive so that the voltage of the power source $E_2$ (8 volts) is applied to the TS lines $11_2$, $11_3$, and $11_4$, respectively. Through the switching actions of the transistors, the first TS line $11_1$ is applied with 24 volts and the remaining three TS lines $11_2$ through $11_4$ are applied with 8 volts.

When the TS line $11_1$ is applied with 24 volts (the voltage of the power source $E_1$), the piezoelectric elements belonging to the first group are selectively driven, subject to connections of the corresponding selection lines to the third voltage source $E_3$, i.e., ground. To this end, any of the transistors $23_1$ through $23_M$ corresponding to the piezoelectric elements to be driven are rendered conductive in response to a print signal.

For example, when the print signal indicates that the piezoelectric element $4_{11}$ connected to the first selection line $12_1$ is to be driven, the transistor $23_1$ is rendered conductive so that the selection line $12_1$ is connected to the third voltage source $E_3$, i.e., ground. If the remaining piezoelectric elements belonging to the first group are not to be driven, the transistors $23_2$ through $23_M$ are rendered non-conductive. Instead, the transistors $24_2$ through $24_M$ are rendered conductive so that the voltage of the power source $E_4$ (16 volts) is applied to the selection lines $12_2$ through $12_M$, respectively.

As described, the driving piezoelectric element in the first group is applied with 24 volts on its positive electrode and zero volt on its negative electrode. The non-driving piezoelectric elements in the first group are applied with 24 volts on their positive electrodes and 16 volts on their negative electrodes. Consequently, 24 volts is applied across the driving piezoelectric element and 8 volts is applied across the non-driven piezoelectric elements belonging to the first group. To other non-driving piezoelectric elements belonging to the groups other than the first group, 8 volts is applied to their positive electrodes and zero volt is applied to their negative electrodes, or 8 volts is applied to their positive electrodes and 16 volts is applied to their negative electrodes. Consequently, 8 volts or −8 volts is applied to the non-driving piezoelectric elements in the second, third and fourth groups.

In the end of each phase of driving, all the piezoelectric elements are again initialized and placed in the standby condition by rendering the transistors $25_1$ through $25_4$ conductive. Thereafter, the second to fourth phase drivings are sequentially performed in the similar manner.

Next, a second embodiment of the present invention will be described while referring to FIGS. 7 and 8.

Figure 7:
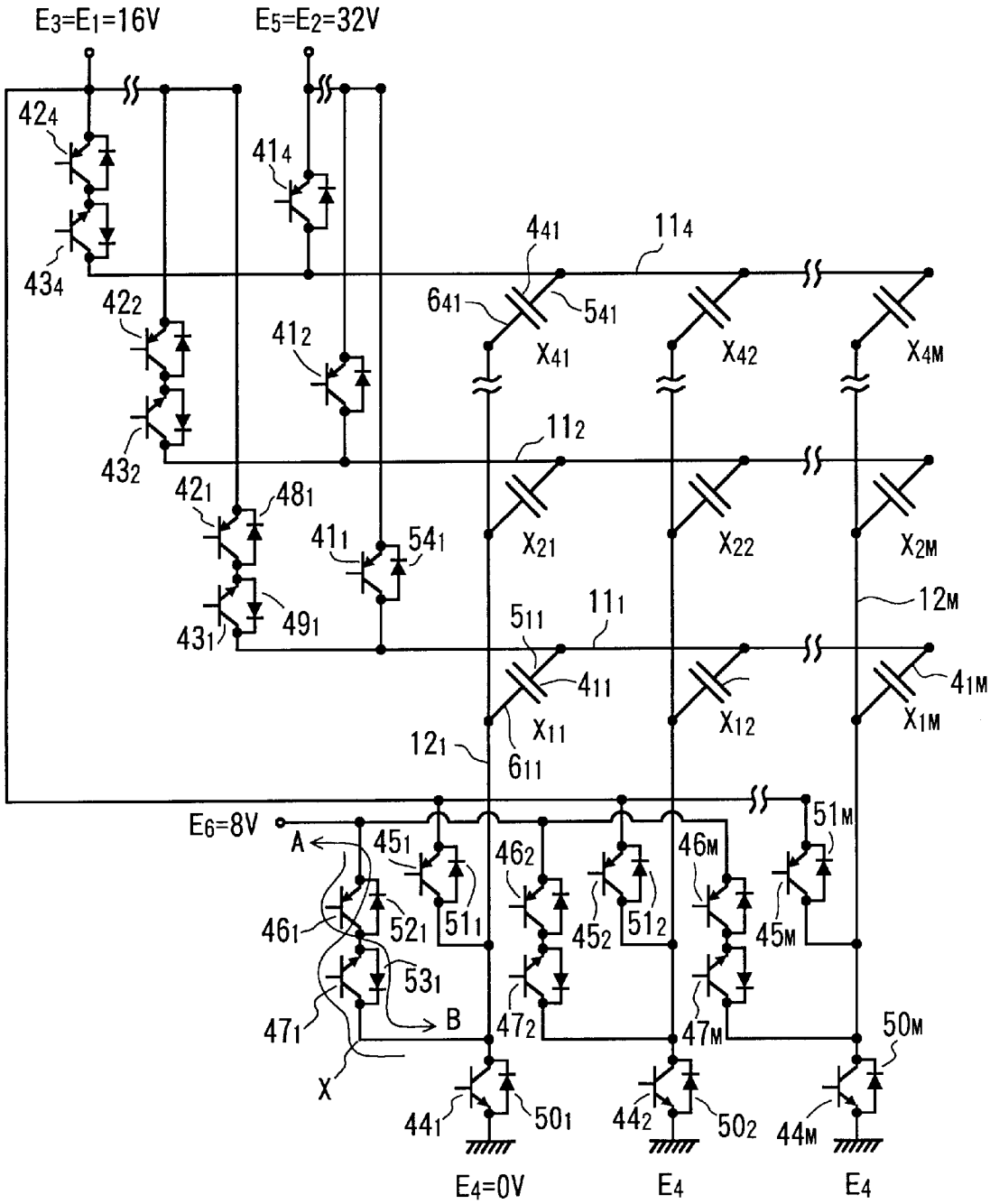
FIG. 7 is a circuit diagram showing a matrix driving circuit of an ink jet printer according to another embodiment of the present invention.

In the second embodiment shown in FIG. 7, the piezoelectric elements are arranged in a matrix form and divided into four groups and M-number sub-groups as in the first embodiment. The connections of four TS lines $11_1$ through $11_4$ and M-number selection lines $12_1$ through $12_M$ to the piezoelectric elements are also identical to those shown in FIG. 5.

In the second embodiment, the first TS line $11_1$ is connected to a first voltage source $E_1$ and a second voltage source $E_2$ through respective drivers. The first voltage source $E_1$ supplies 16 volts and the second voltage source $E_2$ supplies 32 volts. An $E_1$-to-$11_1$ driver connected between the first voltage source $E_1$ to the first TS line $11_1$ includes a series connection of a PNP transistor $42_1$ and an NPN transistor $43_1$, and diodes $48_1$ and $49_1$. The diodes $48_1$ and $49_1$ are connected in parallel with the transistors $42_1$ and $43_1$, respectively.

An $E_2$-to-$11_1$ driver connected between the second voltage source $E_2$ and the first TS line $11_1$ includes a PNP transistor $41_1$ and a diode $54_1$ connected in parallel with the transistor $41_1$ in opposite polarity. The second to fourth TS lines $11_2$ to $11_4$ are also connected to the voltage sources $E_1$ and $E_2$ through the similarly configured drivers. The second voltage source $E_2$ and its associated driver is commonly used as a fifth voltage source $E_5$ and its associated driver.

The selection lines $12_1$ through $12_M$ are connected to a third voltage source $E_3$ through respective drivers. The first voltage source $E_1$ is commonly used as the third voltage source $E_3$, thus supplying 16 volts. An $E_3$-to-$12_1$ driver connected between the first selection line $12_1$ to the third voltage source $E_3$ includes a PNP transistor $45_1$ and a diode $51_1$ connected in parallel to the transistor $45_1$ in an opposite polarity. The second to M-th selection lines $12_1$ through $12_M$ are also connected to the third voltage source $E_3$ through the similarly configured drivers.

Further, the selection lines $12_1$ through $12_M$ are connected to ground serving as a fourth voltage source $E_4$ through respective drivers. An $E_4$-to-$12_1$ driver connected between the first selection line $12_1$ to the third voltage source $E_3$, i.e., ground, includes an NPN transistor $44_1$ and a diode $50_1$ connected in parallel to the transistor $44_1$ in an opposite polarity. The second to M-th selection lines $12_2$ through $12_M$ are also connected to the fourth voltage source $E_4$, i.e., ground, through the similarly configured drivers.

The selection lines $12_1$ through $12_M$ are connected to a sixth voltage source $E_6$ through respective drivers. The sixth voltage source $E_6$ supplies 8 volts. An $E_6$-to-$12_1$ driver connected between the first selection line $12_1$ to the sixth voltage source $E_6$ includes a series connection of a PNP transistor $46_1$ and an NPN transistor $47_1$, and diodes $52_1$ and $52_1$. The diodes $52_1$ and $52_1$ are connected in parallel to the transistors $46_1$ and $47_1$ in opposite polarity, respectively. The second to M-th selection lines $12_2$ through $12_M$ are also connected to the sixth voltage source $E_6$ through the similarly configured drivers.

A current may flow in the direction A when the transistor $46_1$ is rendered conductive, so the diode $52_1$ is connected in opposite polarity in parallel with the transistor $46_1$. Further, to allow a current to flow in the direction B, the diode $53_1$ is connected in parallel with the transistor $47_1$. The transistor $47_1$ is provided so that a current does not flow into the diode $52_1$ from the X point. Because the X point is applied with 16 volts when the transistor $46_1$ is rendered non-conductive and the transistor $45_1$ is rendered conductive. The same is true with respect to the transistors $47_2$ through $47_M$.

In the second embodiment, first to sixth voltage sources $E_1$ through $E_6$ are provided. The first and third voltage sources $E_1$ and $E_3$ supply 16 volts, the second and fifth voltage sources $E_2$ and $E_5$ supply 32 volts, the fourth voltage source $E_4$ supplies zero volt, and the sixth voltage source $E_6$ supplies 8 volts.

Figure 8:
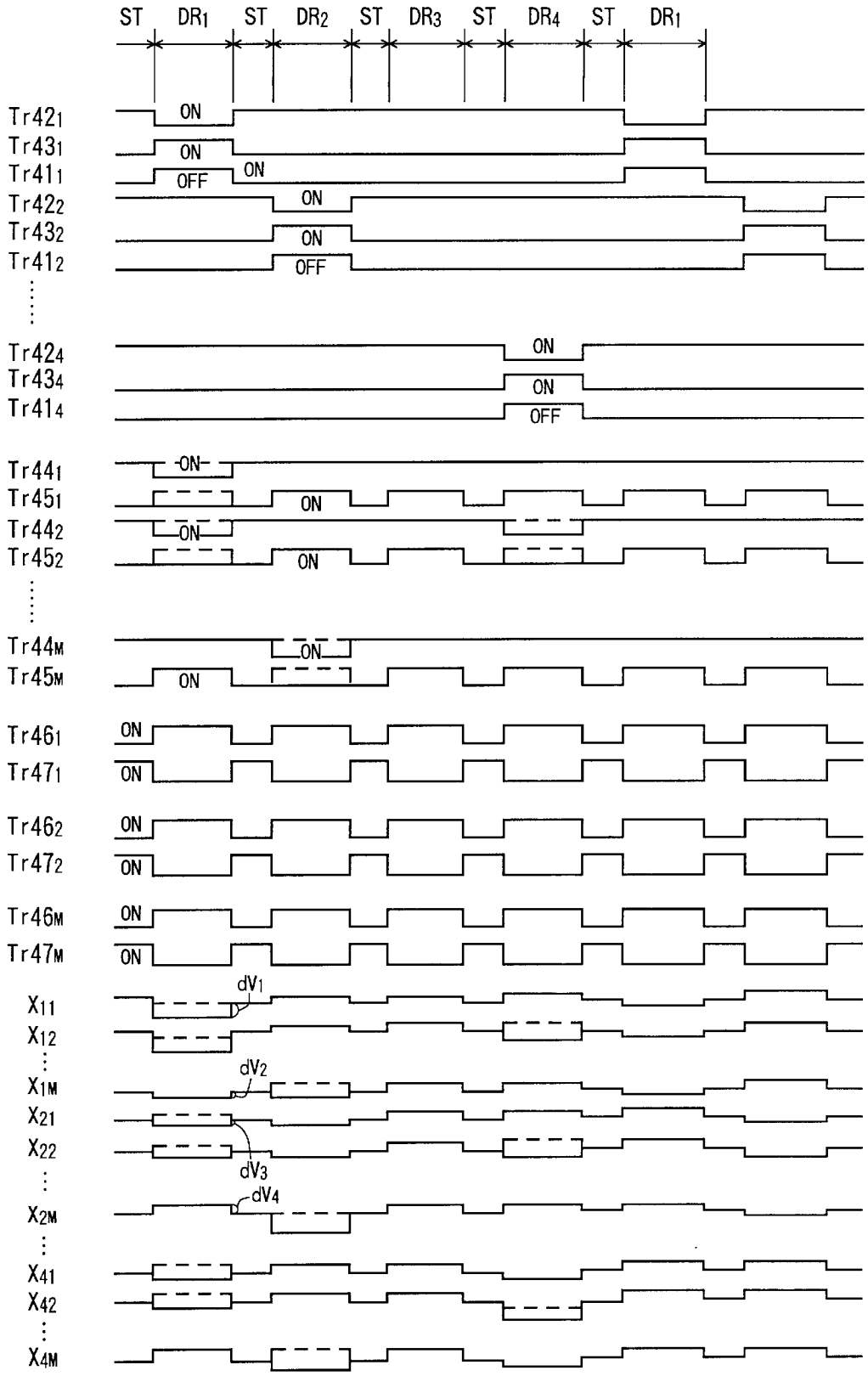
FIG. 8 is a timing chart of various signals applied to the components of the matrix driving circuit shown in FIG. 7 and also voltages developed across the piezoelectric components.

Referring next to FIG. 8, a driving method for the circuit shown in FIG. 7 will be described. FIG. 8 shows timing charts of signals applied to the bases of transistors included in the circuit shown in FIG. 7 and of the voltages developed across the piezoelectric elements.

In the standby condition indicated by "ST" in the timing chart of FIG. 8, the transistors $\mathbf{41}_1$ through $\mathbf{41}_4$ are simultaneously rendered conductive so that all of the TS lines $\mathbf{11}_1$ through $\mathbf{11}_4$ are connected to the fifth voltage source $E_5$ (32 volts). The transistors $\mathbf{46}_1$ through $\mathbf{46}_M$ and $\mathbf{47}_1$ through $\mathbf{47}_M$ are also rendered conductive so that the selection lines $\mathbf{12}_1$ through $\mathbf{12}_M$ are connected to the sixth voltage source $E_6$ (8 volts). The remaining transistors are held non-conductive. All the piezoelectric elements are applied with 32 volts on their positive electrodes and 8 volts on their negative electrodes, so 24 volts is applied across each of the piezoelectric element. In this manner, all the piezoelectric elements are initialized and placed in a standby condition.

In the first phase driving DR1, the transistors $\mathbf{42}_1$ and $\mathbf{43}_4$ are rendered conductive so that 16 volts of the first voltage source $E_1$ is applied to the first TS line $\mathbf{11}_1$. At this time, the transistor $\mathbf{41}_1$ is rendered non-conductive to prevent the voltage source $E_1$ from being interfered by the voltage source $E_2$ (or $E_5$). The transistors $\mathbf{41}_2$, $\mathbf{41}_3$ (not shown) and $\mathbf{41}_4$ are rendered conductive so that the voltage of the power source $E_2$ (32 volts) is applied to the TS lines $\mathbf{11}_2$, $\mathbf{11}_3$, and $\mathbf{11}_4$, respectively. The transistors $\mathbf{42}_2$ through $\mathbf{42}_4$ and $\mathbf{43}_2$ through $\mathbf{43}_4$ are rendered non-conductive. Through the switching actions of the transistors, the first TS line $\mathbf{11}_1$ is applied with 16 volts and the remaining three TS lines $\mathbf{11}_2$ through $\mathbf{11}_4$ are applied with 32 volts.

When the TS line $\mathbf{11}_1$ is applied with 16 volts (the voltage of the power source $E_1$), the piezoelectric elements belonging to the first group are selectively driven, subject to connections of the corresponding selection lines to the third voltage source $E_3$ (16 volts). To this end, any of the transistors $\mathbf{23}_1$ through $\mathbf{23}_M$ corresponding to the piezoelectric elements to be driven are rendered conductive in response to a print signal.

For example, when the print signal indicates that the piezoelectric element $\mathbf{4}_{1M}$ connected to the M-th selection line $\mathbf{12}_M$ is to be driven, the transistor $\mathbf{45}_M$ is rendered conductive and the transistor $\mathbf{44}_M$ is rendered non-conductive so that the selection line $\mathbf{12}_M$ is connected to the third voltage source $E_3$ (16 volts). If the remaining piezoelectric elements belonging to the first group are not to be driven, the transistors $\mathbf{45}_1$ through $\mathbf{45}_{M-1}$ are rendered non-conductive and the transistors $\mathbf{44}_1$ through $\mathbf{44}_{M-1}$ are rendered conductive so that the selection lines $\mathbf{11}_1$ through $\mathbf{12}_{M-1}$ are connected to ground serving as the fourth voltage source $E_4$.

As described, the driving piezoelectric element in the first group is applied with 16 volts on its positive electrode and 16 volt on its negative electrode. Three types of non-driving piezoelectric elements exist. The first type non-driving piezoelectric element is the one whose TS line is selected but selection line is not selected. The second type non-driving piezoelectric element is the one whose TS line is not selected but selection line is selected. The third type non-driving piezoelectric element is the one whose TS line and selection line are not selected. Therefore, the voltage $V_2$ applied across the first type non-driving piezoelectric element is $E_1$–$E_4$, The voltage $V_3$ applied across the second type non-driving piezoelectric element is $E_2$–$E_3$. The voltage $V_4$ applied across the third type non-driving piezoelectric element is $E_2$–$E_4$.

Specifically, to the first type non-driving piezoelectric elements, 16 volts is applied to their positive electrodes and zero volt is applied to their negative electrodes. To the second type non-driving piezoelectric elements, 32 volts is applied to their positive electrodes and 16 volt is applied to their negative electrodes. To the third type non-driving piezoelectric elements, 32 volts is applied to their positive electrodes and zero volt is applied to their negative electrodes. Consequently, 16 volts, 16 volts, and 32 voltages are applied to the first to third types of non-driving piezoelectric elements, respectively.

The driving differential voltage $dV_1$ is given by $V_1$–$V_0$. The non-driving differential voltage $dV_2$ for the first type non-driving piezoelectric element is given by $V_2$–$V_0$. The non-driving differential voltage $dV_3$ for the second type non-driving piezoelectric element is given by $V_3$–$V_0$. The non-driving differential voltage $dV_4$ for the third type non-driving piezoelectric element is given by $V_4$–$V_0$.

The driving differential voltage dV, applied across the driving piezoelectric element is 0–24=–24 volts. The non-driving differential voltage $dV_2$ applied across the first type non-driving piezoelectric element is 16–24=–8 volts. The non-driving differential voltage $dV_3$ applied across the second type non-driving piezoelectric element is 16–24=–8 volts. The non-driving differential voltage $dV_4$ applied across the third type non-driving piezoelectric element is 32–24=8 volts.

In the end of each phase of driving, all the piezoelectric elements are again initialized and placed in the standby condition by rendering the transistors $\mathbf{41}_1$ through $\mathbf{41}_4$, $\mathbf{46}_1$ through $\mathbf{46}_M$, and through $\mathbf{47}_1$ through $\mathbf{47}_M$ conductive. Thereafter, the second to fourth phase drivings are sequentially performed in the similar manner.

While exemplary embodiments of this invention have been described in detail, those skilled in the art will recognize that there are many possible modifications and variations which may be made in these exemplary embodiments while yet retaining many of the novel features and advantages of the invention. Accordingly, all such modifications and variations are intended to be included within the scope of the appended claims.

What is claimed is:

1. A method of driving an ink jet printer including:

a plurality of piezoelectric elements divided into N groups, each of said N groups containing M-number piezoelectric elements, said plurality of piezoelectric elements further divided into M sub-groups, each of said M sub-groups containing N-number piezoelectric elements belonging to respective ones of said N groups individually, wherein N and M are integers equal to or greater than two, each of said plurality of piezoelectric elements having a first electrode and a second electrode;

N-number time sharing lines provided in one-to-one correspondence to said N groups and connected to the first electrodes of said M-number piezoelectric elements belonging to corresponding groups; and M-number selection lines provided in one-to-one correspondence to said M sub-groups and connected to the second electrodes of said N-number piezoelectric elements belonging to corresponding sub-groups, the method comprising the steps of:

coupling a driving voltage to a selected piezoelectric element through a corresponding time sharing line and a corresponding selection line; and coupling non-driving voltages to all non-selected piezoelectric elements through corresponding time sharing lines and corresponding selection lines, wherein each of the non-driving voltages corresponds to a fraction of said driving voltage, wherein an ink droplet is ejected from a nozzle corresponding to said selected piezoelectric element and wherein the fraction of said driving voltage corresponding to each of said non-driving voltages is sufficient so that no ink droplet is ejected from nozzles corresponding to said non-selected piezoelectric elements.

2. The method according to claim 1, wherein each of the non-driving voltages are a same voltage equal to a same fraction of said driving voltage.

3. The method according to claim 2, wherein said same fraction is plus or minus one-third of said driving voltage.

4. The method according to claim 3, further comprising the step of applying an initializing voltage to said plurality of piezoelectric elements immediately before applying the driving voltage to the selected piezoelectric element.

5. The method according to claim 4, wherein said step of applying an initializing voltage comprises the steps of connecting said N-number time sharing lines and said M-number selection lines to ground.

6. An ink jet printer comprising:

a plurality of piezoelectric elements divided into N groups, each of said N groups containing M-number piezoelectric elements, said plurality of piezoelectric elements further divided into M sub-groups, each of said M sub-groups containing N-number piezoelectric elements belonging to respective ones of said N groups individually, wherein N and M are integers equal to or greater than two, each of said plurality of piezoelectric elements having a first electrode and a second electrode;

N-number time sharing lines provided in one-to-one correspondence to said N groups and connected to the first electrodes of said M-number piezoelectric elements belonging to corresponding groups;

M-number selection lines provided in one-to-one correspondence to said M sub-groups and connected to the second electrodes of said N-number piezoelectric elements belonging to corresponding sub-groups;

first voltage switching means for sequentially applying a first voltage to said N-number time sharing lines so that a selected one of said N-number time sharing lines is applied with the first voltage;

second voltage switching means for applying a second voltage to a non-selected one of said N-number time sharing lines;

third voltage switching means for applying a third voltage to a selected one of said M-number selection lines in timingly coincidence with application of the first voltage to said selected one of said N-number time sharing lines;

fourth voltage switching means for applying a fourth voltage to a non-selected one of said N-number selection lines, wherein a selected piezoelectric element connected between said selected one of said N-number time sharing lines and said selected one of said N-number selection lines is applied with a driving voltage representative of a voltage on said first electrode relative to a voltage on said second electrode, and wherein said first, second, third, and fourth voltages are set so that all non-selected piezoelectric elements are applied with non-driving voltages each equaling a fraction of said driving voltage so that no ink flows from nozzles corresponding to said non-selected piezoelectric elements.

7. The ink jet printer according to claim 6, wherein the voltages applied to all of said non-selected piezoelectric elements are a same voltage equal to a same fraction of said driving voltage.

8. The ink jet printer according to claim 7, wherein said same fraction is plus or minus one-third of said driving voltage.

9. The ink jet printer according to claim 8, further comprising:

fifth voltage switching means for applying a fifth voltage to said N-number time sharing lines; and sixth voltage switching means for applying a sixth voltage to said M-number selection lines in timingly coincidence with application of said fifth voltage to said N-number time sharing lines so that said plurality of piezoelectric elements are applied with an initialization voltage.

10. The ink jet printer according to claim 9, wherein said initialization voltage is applied to said plurality of piezoelectric elements immediately before said selected piezoelectric element is applied with the driving voltage.

11. The ink jet printer according to claim 10, wherein said third voltage switching means, said fifth voltage switching means, and said sixth voltage switching means apply zero volt, said first voltage switching means applies the first voltage that is three times as large as the second voltage applied by said second voltage switching means, and said fourth voltage switching means applies the fourth voltage that is twice as large as the second voltage applied by said second voltage switching means.

12. The ink jet printer according to claim 11, wherein said first voltage switching means, second voltage switching means, third voltage switching means, fourth voltage switching means, fifth voltage switching means and sixth voltage switching means each comprise a diode in parallel with a bipolar transistor for selectively coupling a voltage supply line to a respective time sharing line or a selection line.

13. The ink jet printer according to claim 10, wherein both said first voltage switching means and said third voltage switching means apply a voltage that is twice as large as the sixth voltage applied by said sixth voltage switching means, and both said second voltage switching means and said fifth voltage switching means apply a voltage that is twice as large as the voltage applied by said first voltage switching means and said third voltage switching means.

14. The ink jet printer according to claim 13, wherein said first voltage switching means, second voltage switching means, third voltage switching means, fourth voltage switching means, fifth voltage switching means and sixth voltage switching means each comprise a diode in parallel with a bipolar transistor for selectively coupling a voltage supply line to a respective time sharing line or a selection line.

15. The ink jet printer according to claim 8, further comprising:

a frame;

a nozzle plate formed with a plurality of nozzles therein;

a plurality of walls attached to said nozzle plate; and a partition membrane, said nozzle plate, said plurality of walls, and said partition membrane defining a plurality of pressure chambers separated by said plurality of walls, each of said plurality of pressure chambers being filled with ink, wherein each of said plurality of piezoelectric elements has a longitudinal axis extending perpendicular to said partition membrane, a first surface in parallel with said longitudinal axis, a second surface in parallel with said longitudinal axis and opposite said first surface, a first end secured to said partition membrane, and a second end secured said frame.

16. The ink jet printer according to claim 15, wherein said first electrode is attached to said first surface, and said second electrode is attached to said second surface.

17. The ink jet printer according to claim 15, wherein said first electrode is interposed between said partition membrane and said first end, and said second electrode is interposed between second end and said frame.

18. The ink jet printer according to claim 8, wherein said first voltage switching means, second voltage switching means, third voltage switching means and fourth voltage switching means each comprise a diode in parallel with a bipolar transistor for selectively coupling a voltage supply line to a respective time sharing line or a selection line.

19. A method of driving an ink jet printer including:

a plurality of piezoelectric elements divided into N groups, each of said N groups containing M-number piezoelectric elements, said plurality of piezoelectric elements further divided into M sub-groups, each of said M sub-groups containing N-number piezoelectric elements belonging to respective ones of said N groups individually, wherein N and M are integers equal to or greater than two, each of said plurality of piezoelectric elements having a first electrode and a second electrode;

N-number time sharing lines provided in one-to-one correspondence to said N groups and connected to the first electrodes of said M-number piezoelectric elements belonging to corresponding groups;

M-number selection lines provided in one-to-one correspondence to said M sub-groups and connected to the second electrodes of said N-number piezoelectric elements belonging to corresponding sub-groups, the method comprising the steps of:

(a) sequentially coupling a first voltage to a selected one of said N-number time sharing lines;

(b) coupling a second voltage to a non-selected one of said N-number time sharing lines;

(c) coupling a third voltage to a selected one of said M-number selection lines in timingly coincidence with coupling the first voltage to said selected one of said N-number time sharing lines;

(d) coupling a fourth voltage to a non-selected one of said M-number selection lines, wherein a selected piezoelectric element connected between said selected one of said N-number time sharing lines and said selected one of said M-number selection lines is coupled to a driving voltage representative of a voltage on said first electrode relative to a voltage on said second electrode, and wherein all non-selected piezoelectric elements are coupled to voltages each equaling a fraction of said driving voltage and each being sufficient to ensure that no ink droplet is ejected from nozzles corresponding to said non-selected piezoelectric elements.

20. The ink jet printer according to claim 19, wherein said same fraction is plus or minus one-third of said driving voltage.

21. The method according to claim 20, wherein each of the non-driving voltages are a same voltage equal to a same fraction of said driving voltage.

22. The method according to claim 21, further comprising the steps of:

(e) coupling a fifth voltage to said N-number time sharing lines; and (f) coupling a sixth voltage to said M-number selection lines in timingly coincidence with coupling said fifth voltage to said N-number time sharing lines so that said plurality of piezoelectric elements are coupled to an initialization voltage.

23. The method according to claim 22, further comprising the step of applying said initialization voltage to said plurality of piezoelectric elements immediately before said selected piezoelectric element is applied with the driving voltage.

24. The method according to claim 23, wherein zero voltage is applied in steps (c), (f), and (f), the first voltage applied in step (a) is three tires as large as the second voltage applied in step (b), and the fourth voltage applied in step (d) is twice as large as the second voltage applied in step (b).

25. The method according to claim 23, wherein a voltage applied in steps of (a) and (c) is twice as large as the, sixth voltage applied in step (f), and a voltage applied in steps of (b) and (e) is twice as large as the voltage applied In step of (a) and (c).

* * * * *